United States Patent [19]

Nishiyama et al.

[11] 4,429,441

[45] Feb. 7, 1984

[54] METHOD AND APPARATUS FOR MANUFACTURING A HOOKED FASTENER PART FOR HOOK-AND-LOOP FASTENERS

[75] Inventors: Hissai Nishiyama, Hayahoshi; Takao Kanada, Kurobe, both of Japan

[73] Assignee: Yoshida Kogyo K. K., Tokyo, Japan

[21] Appl. No.: 334,253

[22] Filed: Dec. 24, 1981

[30] Foreign Application Priority Data

Dec. 29, 1980 [JP] Japan ..... 55-186254
Dec. 29, 1980 [JP] Japan ..... 55-186255

[51] Int. Cl.[3] ..... D06C 13/08

[52] U.S. Cl. ..... 26/9; 83/54; 83/411 R; 83/909; 24/442

[58] Field of Search ..... 83/54, 909, 411 R, 35; 24/204; 26/9

[56] References Cited

U.S. PATENT DOCUMENTS 2,933,797 4/1960 Mestral ..... 26/9
3,363,038 1/1968 Billarant ..... 24/204 X
3,550,223 12/1970 Erb ..... 26/9 X
3,586,060 6/1971 Erb ..... 26/9 X
3,673,301 6/1972 Billaran ..... 26/9 X
3,695,976 10/1972 Erb ..... 24/204 X
3,732,604 5/1973 Erb ..... 26/9 X

FOREIGN PATENT DOCUMENTS 42-13511 8/1967 Japan .

*Primary Examiner*—Donald R. Schran
*Attorney, Agent, or Firm*—Hill, Van Santen, Steadman & Simpson

[57] ABSTRACT

A continuous base of sheet material carrying on its one surface a number of successive rows of laterally spaced loops raised from the one surface is advanced continuously or intermittently along an arcuate path with the loops directed outwardly of the arcuate path. Each of the loops of one of the rows is cut on one of its legs at a two different points by reciprocating a cooperating pair of relatively movable cutting members two times along a given reciprocating path while the one row of loops is in the reciprocating path of the cutting members along the arcuate path.

15 Claims, 14 Drawing Figures

METHOD AND APPARATUS FOR MANUFACTURING A HOOKED FASTENER PART FOR HOOK-AND-LOOP FASTENERS

BACKGROUND OF THE INVENTION

1. Field of the Invention

The present invention relates to a method and an apparatus for manufacturing a hooked fastener part for hook-and-loop fasteners.

1. Prior Art

According to a known method and apparatus of the type described above, a hooked fastener part is produced by cutting loops on a base near the respective outer ends. Hook-shaped material engaging elements thus formed each provide only a small opening through which a loop on a mating looped fastener part is brought into hooking engagement with the hook-shaped engaging element. Such small opening hinders smooth engagement of the hook with the loop, with the result that the possibility of hooking between hooks and loops, i.e., the firmness of engagement of such a hook-and-loop fastener is considerably decreased.

Japanese Patent Publication No. 42-13511, published Aug. 1, 1967 discloses an attempt to provide a relatively large opening with a hook-shaped element. Each loop is cut on it one leg at two different points by means of a pair of parallel spaced upper and lower movable blades and a stationary blade disposed between the movable blades, all the blades being inserted in the loop. The blades need to be thin enough to pass through such small loops and are liable to be damaged or sometimes broken. Furthermore, it has been proven difficult to insert the cutter blades into such loops of irregular shape such as being kinked or collapsed, leaving the loops uncut on the hooked fastener part.

SUMMARY OF THE INVENTION

According to a first aspect of the invention, there is provided a method for manufacturing a hooked fastener part for hook-and-loop fasteners, comprising the steps of: feeding a continuous base of sheet material having a number of successive rows of laterally spaced loops projecting from one surface of the base in a longitudinal direction along an arcuate path with said loops directed away from the center of said arcuate path; introducing said rows of loops, successively into a given reciprocating path of a cooperating pair of cutting members relatively movable toward and away from each other along said reciprocating path; and cutting each loop of one of said rows on its one leg at two different points by reciprocating said cutting members two times while said one row of loops is in said reciprocating path of said cutting members along said arcuate path. The base may be fed continually or intermittently.

According to a second aspect of the invention, there is provided a method for manufacturing a hooked fastener part for hook-and-loop fasteners, comprising the steps of: feeding a continuous base of sheet material having a number of successive rows of laterally spaced loops projecting from one surface of the base intermittently in a longitudinal direction along an arcuate path with said loops being directed away from the center of said arcuate path; introducing said rows of loops, while being intermittently fed along said arcuate path, successively one at a time into a given reciprocating path of a cooperating pair of cutting members relatively movable toward and away from each other along said reciprocating path, said reciprocating path extending in a plane substantially parallel to a tangent to said arcuate path; cutting each loop of one of said rows on one of its legs at a first point between the outer end of each loop and said surface of the base by once reciprocating said cutting members while said one row of loops is at rest in said reciprocating path of said cutting members; displacing said center of said arcuate path in a direction perpendicular to said plane of said reciprocating path while said one row of loops is still at rest in said reciprocating path of said cutting members; and cutting each loop of said one rows, while at rest in said reciprocating path, on said one leg at a second point spaced from said one point by again reciprocating said cutting members.

According to a third aspect of the invention, there is provided an apparatus for manufacturing a hooked fastener part for hook-and-loop fasteners, comprising: means providing an arcuate path for guiding therealong a continuous base of sheet material having a number of successive rows of laterally spaced loops projecting from one surface of the base with said loops being directed away from the center of said arcuate path; means for feeding said base in a longitudinal direction along said continuous arcuate path on said guide means; a cooperating pair of cutting members disposed adjacent to said arcuate path on said guide means and being relatively movable toward and away from each other along a given reciprocating path; and means for actuating said cutting members in synchronism with said feeding means such that said cutting members reciprocate two times while one of said rows of loops is in said reciprocating path of said cutting member along said arcuate path on said guide means.

According to a fourth aspect of the invention, there is provided an apparatus for manufacturing a hooked fastener part for hook-and-loop fasteners, comprising: means providing an arcuate path for guiding therealong a continuous base of sheet material having a number of successive rows of laterally spaced loops projecting from one surface of the base with said loops being directed away from the center of said arcuate path; means for feeding said continuous base intermittently in a direction along said arcuate path on said guide means; a cooperating pair of cutting members disposed adjacent to said arcuate path on said guide means and being relatively movable toward and away from each other along a given reciprocating path, said reciprocating path extending in a plane substantially parallel to a tangent to said arcuate path; means for actuating said cutting members to reciprocate twice with respect to one another each time one of said rows of loops is at rest in said reciprocating path; and means for displacing said center of said arcuate path on said guide means in a direction perpendicular to said reciprocating path of said cutting members in a predetermined timed relation to the reciprocating movement of said cutting members.

It is an object of the invention to provide a method and an apparatus for manufacturing a hooked fastener part for hook-and-loop fasteners which can provide a relatively large opening in each hook-shaped engaging element by cutting one loop on one of its legs at two different points by means of one cutting edge.

Another object of the invention is to provide a method and an apparatus for manufacturing a hooked fastener part for hook-and-loop fasteners wherein such loops of irregular shape can be cut open reliably.

Still another object of the invention is to provide a method and an apparatus which can utilize relatively thick and durable cutting members.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION

Figure 1:
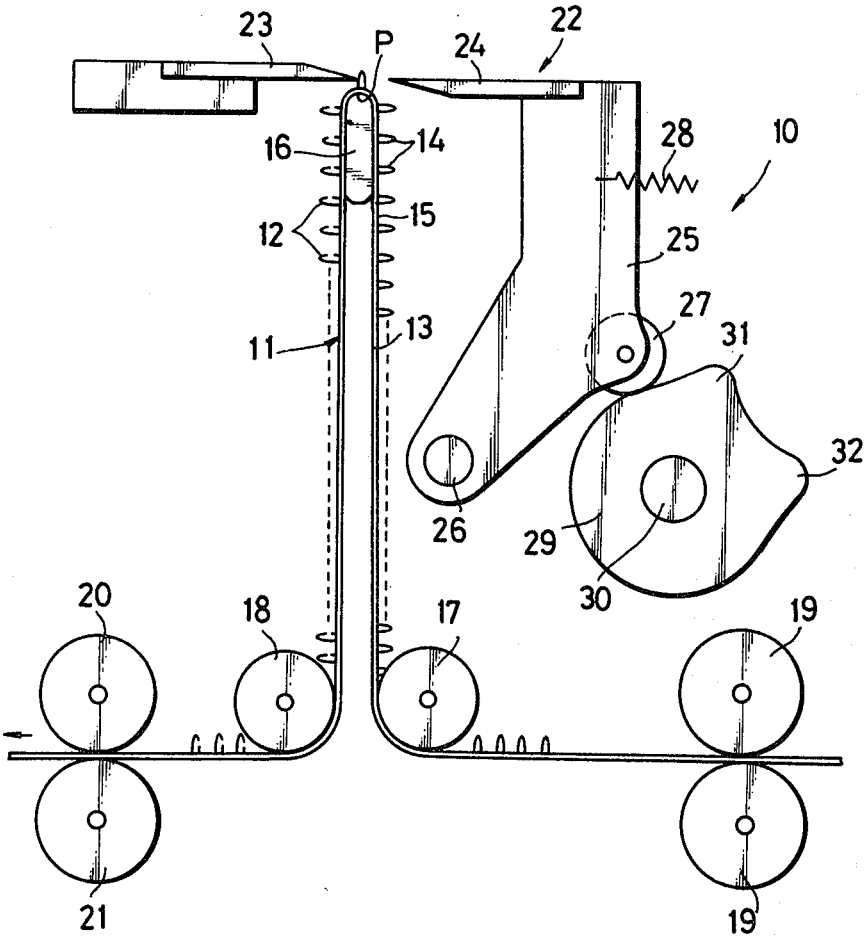
FIG. 1 is a diagrammatic front elevational view of an apparatus constructed in accordance with a first embodiment of the present invention.
Figure 2:
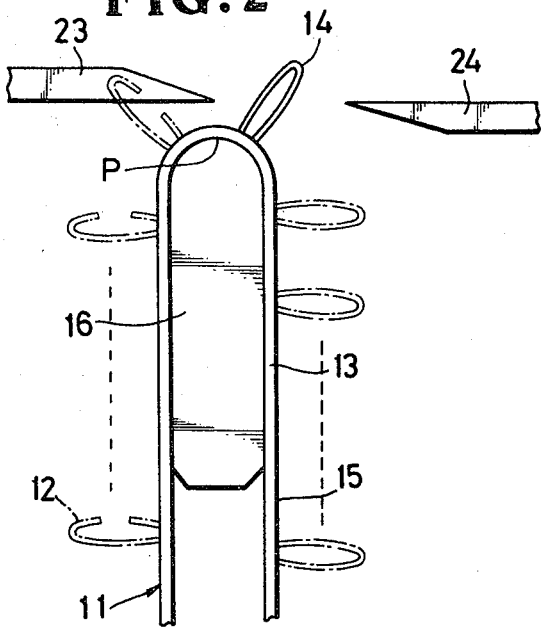
FIGS. 2(*a*) to 6 are views illustrative of succeeding steps of loop-cutting operation, of which FIGS. 2(*a*), 3(*a*), 4(*a*), 5 and 6 are enlarged fragmentary front elevational views of parts of the apparatus of FIG. 1, and FIGS. 2(*b*), 3(*b*) and 4(*b*) are fragmentary plan views of FIGS. 2(*a*), 3(*a*) and 4(*a*), respectively.
Figure 2:
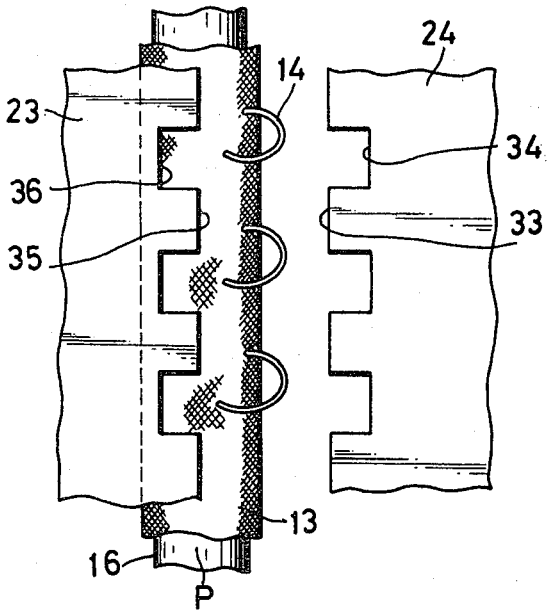

As shown in the drawing, wherein like reference characters designate identical or corresponding parts throughout the several views, and more particularly to FIG. 1, there is shown an apparatus 10 for manufacturing a continuous separable fastener part 11 with hook-shaped material engaging elements 12 extending from a continuous base 13 of sheet material having a number of successive rows of laterally spaced loops 14 (FIG. 2(*b*)) projecting from one surface 15 of the base 13.

The apparatus 10 comprises a guide bar 16 fixed to a frame (not shown) of the apparatus and providing on its periphery an arcuate path P extending for an angle of 180°, and a pair of guide rolls 17,18 rotatably mounted on the frame, the guide roll 17 being disposed upstream of the guide bar 16 and the guide roll 18 being disposed downstream of the guide bar 16. The guide bar 16 and the guide rolls 17,18 are preferably so arranged that the continuous base 13 passes on and along a pair of tangent lines common to the respective circumferences of the guide rolls 17,18 and the arcuate path P on the guide bar 16. A pair of tension rolls 19,19 is disposed upstream of the guide roll 17 and they are normally urged against each other. A feed roll 20 is operatively connected to a suitable driving means (not shown) and a pinch roll 21 is normally urged against the feed roll 20 for advancing, upon rotation of the feed roll 20, the base 13 continuously in a longitudinal direction indicated by the arrow in FIG. 1. As shown in FIG. 1, the continuous base 13 is arranged to pass between the tension rolls 19,19, around the guide roll 17, then around the guide bar 16 with the loops 14 projecting away from the center of the arcuate path P on the guide bar 16, around the guide roll 18, and then between the feed and pinch rolls 20,21.

The apparatus 10 further comprises a cutting device 22 including a cooperating pair of confronting cutting members 23,24 disposed adjacent to the guide bar 16 on the side opposite to the guide rolls 17,18. One cutting member 23 is fixed to the frame whereas the other cutting member 24 is secured to a rocker arm 25 pivotably mounted on the frame by a shaft 26. The rocker arm 25 has a cam follower in the form of a roller 27 normally urged by a spring 28 into contact with a cam 29 mounted on a shaft 30 for corotation therewith. The cam 29 has a cam surface disposed for engagement with the follower roller 27 to thereby bring the movable cutting member 24 twice into registry with the stationary cutting member 23 each time the shaft 30 and hence the cam 29 make one revolution. The cam 29 has on its periphery a pair of projections 31,32 for accomplishing this function.

As shown in FIGS. 2(*a*) and 2(*b*), the cutting members 23,24 extend in a plane substantially parallel to a tangent to the arcuate path P on the guide bar 16, and in the illustrated embodiment, the tangent extends to touch the arcuate path P at the middle point thereof. The cutting members 23,24 are disposed one on each side of the middle point and extend substantially over the full length of the guide bar 16 in parallel relation to the longitudinal axis of the guide bar 16. The movable cutting member 24 has a series of discrete cutting edges 33 spaced longitudinally of the cutting member 24 at equal intervals by a series of equally spaced recesses 34 formed in the cutting member 24. The stationary cutting member 23 also has a series of die edges 35 and recesses 36 similar to those of the movable cutting member 24, each of the die edges 35 being engageable with one of the cutting edges 33. The cutting members 23,24 are so arranged that when the cutting and die edges 33,35 are brought into contact with each other to cut a row of loops 14 on their respective one legs, the recesses 34 and 36 jointly define a series of substantially rectangular openings for receiving therein the other legs of the respective loops 14.

The rate of advance of the base 13 is so synchronized with the reciprocation of the movable cutting member 24 that the movable cutting member 24 makes two cycles of reciprocation while a row of loops 14 is being fed in a given reciprocating path of the movable cutting member 24 along the arcuate path P, thereby each loop 14 is cut on its one leg twice by the cutting members 23,24. In the illustrated embodiment, the reciprocating path extends in a plane substantially parallel to a tangent which extends to touch the arcuate path P at the middle point thereof.

Figure 3:
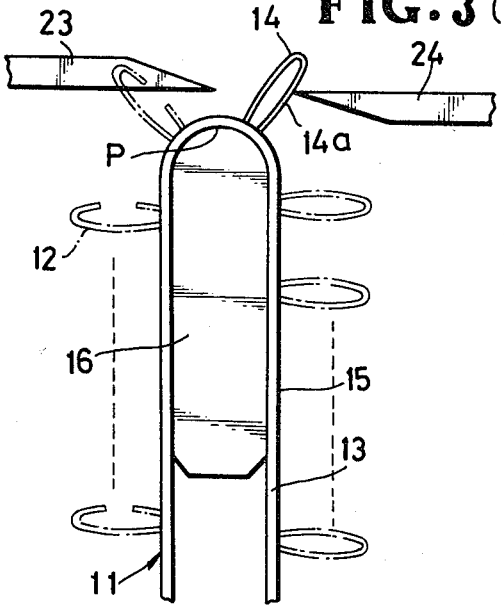
Figure 3:
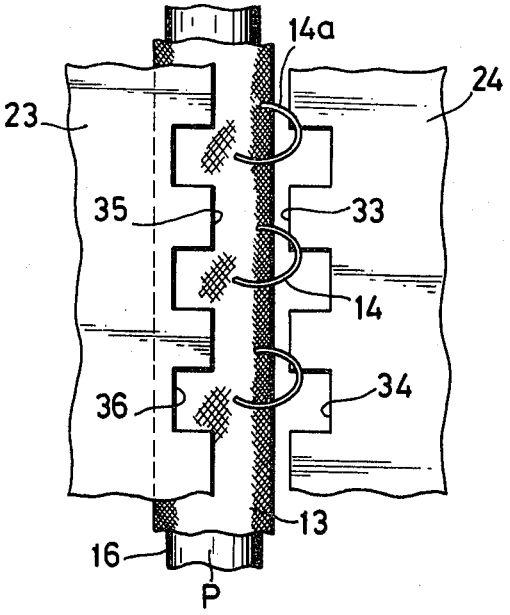
Figure 4:
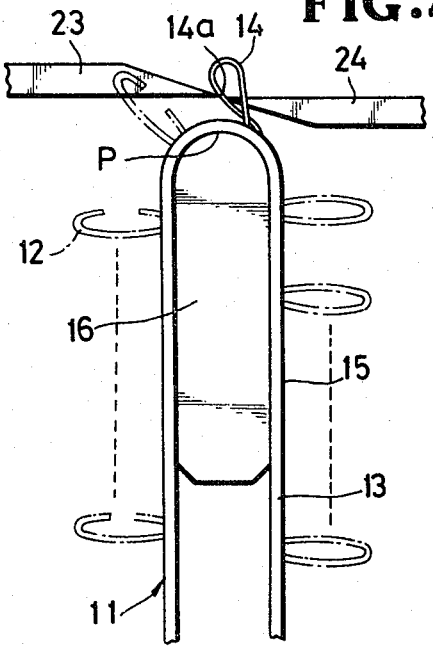
Figure 4:
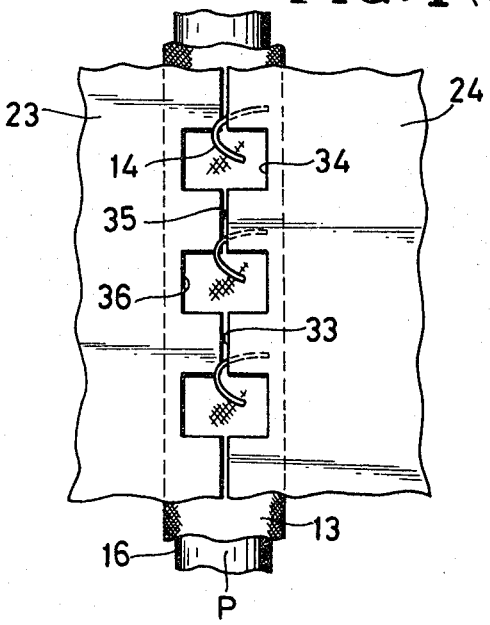
Figure 5:
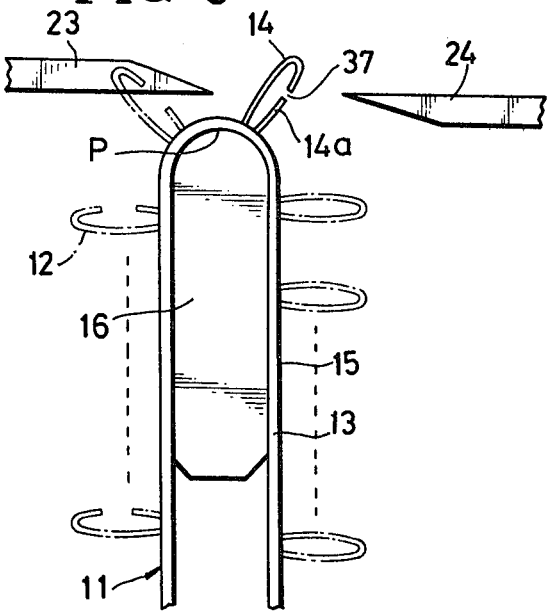

In operation, the base 13 is continuously advanced, in response to rotation of the feed roll 20, along the arcuate path P on the guide bar 16, at a relatively low speed in the direction indicated by the arrow in FIG. 1. The shaft 30 rotates in a counterclockwise direction as viewed in FIG. 1 in the above-described timed relation to the rate of advance of the base 13, whereupon the movable cutting member 24 reciprocates or moves toward and away from the stationary cutting member 23 at a speed substantially higher than that of the base advance. For purposes of illustration, the cycle of cutting operation begins with the parts held in the position shown in FIGS. 2(*a*) and 2(*b*) in which a row of loops 14 shown by solid lines (other rows of loops being shown by dash-and-dot lines for clarification) is introduced into the path of reciprocating movement of the movable cutting member 24 but spaced from the stationary cutting member 23. Upon engagement of the projection 31 on the cam 29 with the follower roller 27, the movable cutting member 24 starts moving toward the stationary cutting member 23 and then the cutting edges 33 thereof contact with one of the legs 14*a* of the respective loops 14 as viewed in FIGS. 3(*a*) and 3(*b*). Continuous movement of the cam 29 further advances the movable cutting member 24 toward the stationary cutting member 23. During that time the legs 14*a* of the loops 14 are forced by the cutting edges 33 to tilt toward the die edges 35 of the stationary cutting member 23. When the top or vertex of the projection 31 on the cam 29 engages with the follower roller 27, the cutting edges 33 and the die edges 35 are brought into contact with each other, whereby the loops 14 are cut on their respective legs 14*a* at a point 37 near the respective outer end thereof, as shown in FIGS. 4(*a*) and 4(*b*). The other legs of the loops 14 are received in the respective openings formed by the recesses 34,36 in the cutting members 23,24 and hence are protected from being cut by the cutting members 23,24. Due to the legs 14*a* being tilted, the distance between the surface 15 on the base 13 and the cutting point 37 is larger than that between the reciprocating path of the cutting member 24 and the surface 15 of the base B, as seen from FIG. 5.

Figure 6:
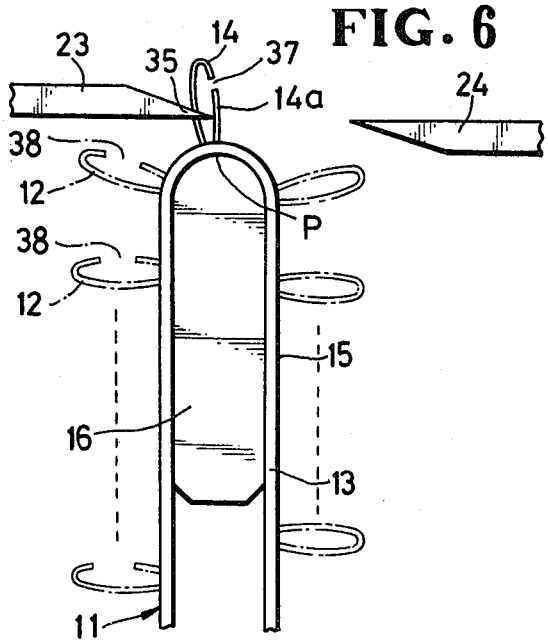

The cam follower 27 then rolls down along the slope of the projection 31 whereby the movable cutting member 24 returns rapidly to its retracted position. During that time, the base 13 which is continuously advanced brings the loops 14 to the position shown in FIG. 6 in which the legs 14*a* of the respective loops 14 approach or substantially make contact with the die edges 35 of the stationary cutting member 23. Substantially at the same time, the projection 32 on the cam 29 passes over the cam follower 27 whereby the movable cutting member 24 again reciprocates with respect to the stationary cutting member 23 so as to cut the legs 14*a* at a second point spaced from the first cutting point 37, the second cutting point being located below the cutting point 37 in the illustrated embodiment. Since the legs 14*a* are cut while being advanced against the die edges 35 of the stationary cutting member 23, the distance between the surface 15 of the base 13 and the second cutting point is substantially equal to that between the reciprocating path of the cutting member 24 and the surface 15 of the base 13.

The foregoing cycle of cutting operation is repeated each time a row of loops is introduced in the reciprocating path of the cutting members 23,24. Hook-shaped material engaging elements 12 thus formed each have a relatively large opening 38 (FIG. 6) which allows a loop or loops on a mating looped fastener part (not shown) to enter into hooking engagement with the hook-shaped element 12 on the hooked fastener part 11 as two fastener parts are pressed into face to face contact together.

Figure 7:
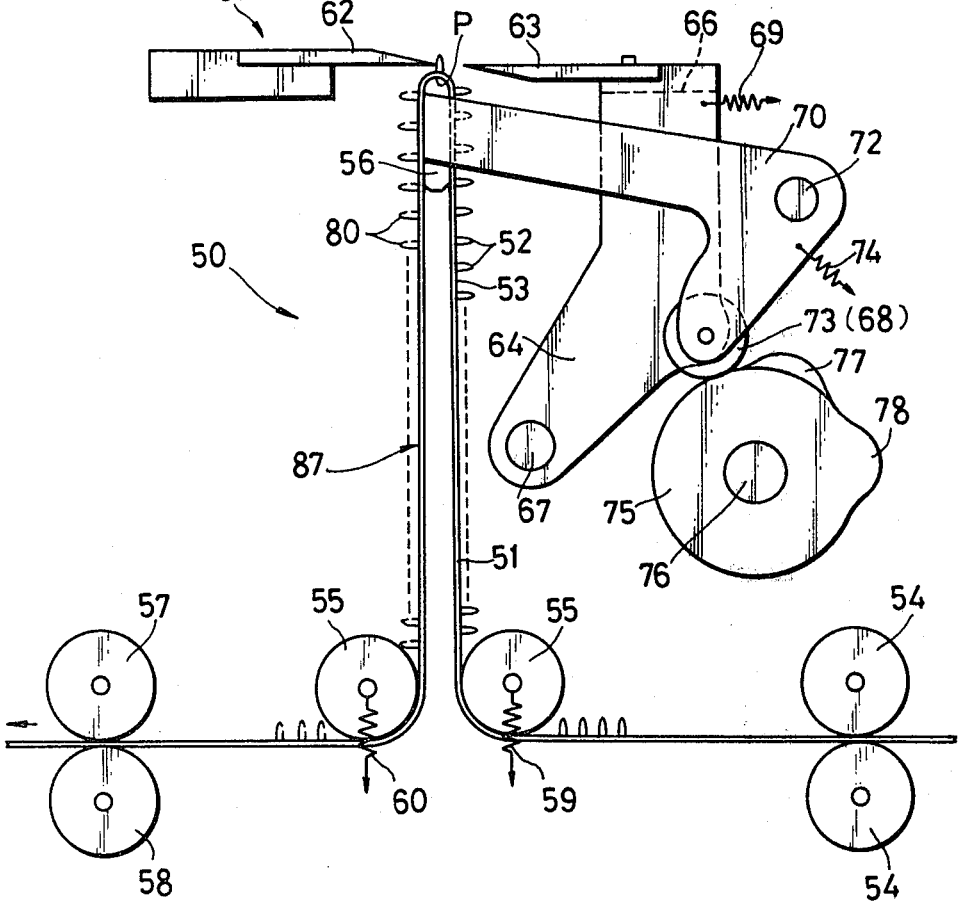
FIG. 7 is a diagrammatic front elevational view of an apparatus according to a second embodiment of the present invention.

In a modified intermittent feed apparatus 50 diagrammatically shown in FIG. 7, a continuous base 51 of sheet material with a number of successive rows of laterally spaced loops 52 projecting from one surface 53 of the base 51 is trained around a guide bar 56 and around a pair of tension rolls 55,55 disposed one on each side of the guide bar 56 and biased by a spring or weight 59,60, respectively to normally urge the other surface of the base 13 downwardly as viewed in FIG. 7, against an arcuate surface P on the guide bar 56. The tension rolls 55,55 are vertically movable for purposes described hereinbelow. A pair of guide rolls 54,54 is disposed upstream of one of the tension rolls 55,55 and the rolls are normally urged against each other. A feed roll 57 is operatively connected to a suitable driving means (not shown) and a pinch roll 58 is normally urged against the feed roll 57 for advancing, upon angular movement of the feed roll 57, the base 51 intermittently in a longitudinal direction indicated by the arrow in FIG. 7. The amount of the angular movement of the feed roll 57 provides a movement at its periphery which corresponds to the distance between adjacent rows of loops 52 or the pitch of the loop rows.

Figure 8:
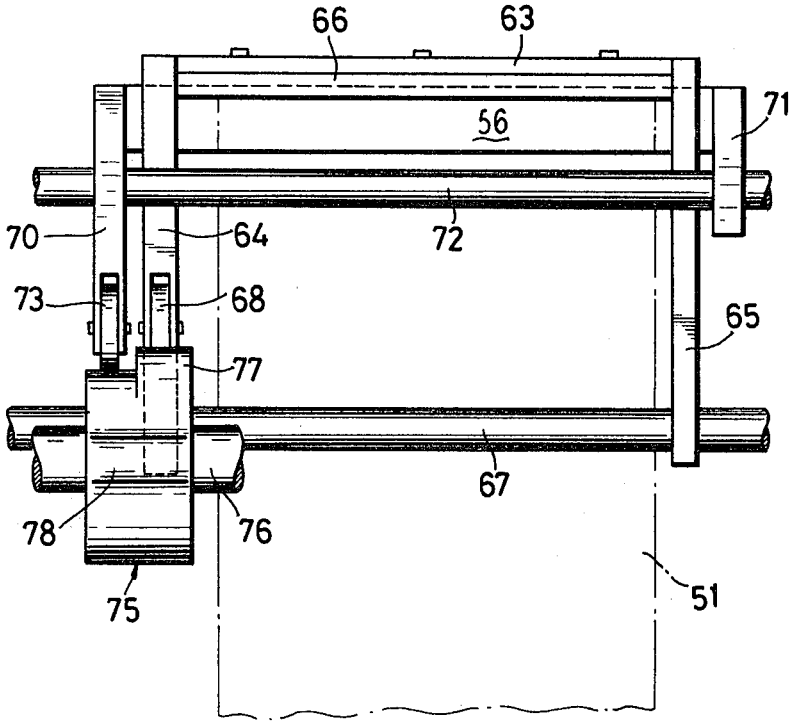
FIG. 8 is a fragmentary side elevational view of FIG. 7.

A cutting device 61 includes a cooperating pair of confronting cutting members 62,63 disposed adjacent to the guide bar 56 on the side opposite to the tension rolls 55,55. The cutting member 62 is fixed to a frame (not shown) of the apparatus 50. As shown in FIG. 8, the cutting member 63 is secured to a support plate 66 which is fixed at its opposite ends to a pair of rocker arms 65 pivotably mounted on a shaft 67. One of the rocker arms is provided with a cam follower in the form of a roller 68 normally urged against a cam 75 by a spring 69 acting between the rocker arm 64 and the frame. The guide bar 56 is secured at its opposite ends to a pair of support levers 70,71 pivotably mounted on a shaft 72. One of the support levers 70 is in the form of a bell crank and provided at its free end with a follower roller 73 normally urged against the cam 75 by a spring 74 acting between the support lever 70 and the frame.

The cam 75 is mounted on a shaft 76 for corotation therewith and has a cam surface comprising a first projection 77 adapted to engage the follower roller 68 mounted on the rocker arm 64 and a second projection 78 adapted to engage both the follower rollers 68,73 mounted respectively on the rocker arm 64 and the support lever 70.

Figure 9:
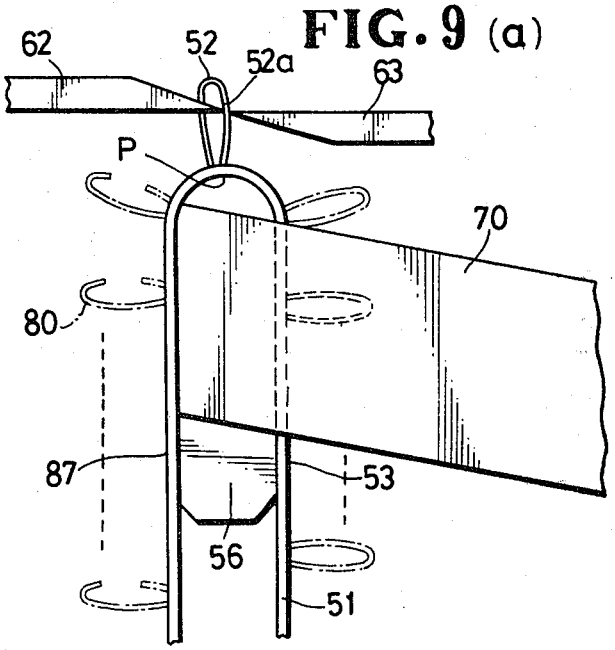
FIGS. 9(*a*), 9(*b*) and 10 are views illustrative of succeeding steps of loop-cutting operation, of which FIGS. 9(*a*) and 10 are enlarged fragmentary front elevational views of parts of the apparatus of FIG. 7, and FIG. 9(*b*) is a fragmentary plan view of FIG. 9(*a*).
Figure 9:
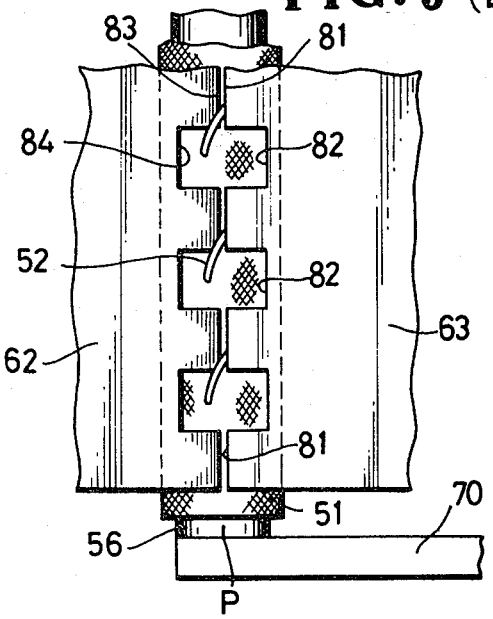

As shown in FIG. 9 (*b*), the movable cutting member 63 has a series of discrete cutting edges 81 spaced longitudinally of the cutting member 63 at equal intervals by a series of equally spaced recesses 82. The stationary cutting member 62 also has die edges 83 and recesses 84 similar to those of the movable cutting member 63. Arrangement of and positional relationship between the guide bar 56, the tension rolls 55,55 and the cutting members 62,63, are substantially the same as those described with respect to the first embodiment and therefore no description of such structural parts is needed.

Upon an increment of angular movement of the feed roll 57, the base 51 moves along the arcuate path P on the guide bar 56 in the direction indicated by the arrow in FIG. 7 by a distance equal to the pitch of the loop rows. While the base 51 is at rest, the shaft 76 and hence the cam 75 completes one revolution. During that time, engagement of the follower roller 68 with the first and second projections 77,78 causes the movable cutting member 63 to reciprocate two times with respect to the stationary cutting member 62 along a given reciprocating path extending substantially parallel to a tangent extending to touch the arcuate path P at the middle point of the same. Engagement of the follower roller 73 with the second projection 78 causes the support levers 70,71 to pivot about the shaft 74 in clockwise direction as viewed in FIG. 7 whereupon the guide bar 56 is slightly displaced upwardly in perpendicular relation to the reciprocating path of the movable cutting member 63.

Cutting operation of the apparatus 50 is described in detail with reference to FIGS. 9(*a*), 9(*b*) and 10. A row of loops 52 (shown by solid lines) on the base 51 which is fed intermittently along the arcuate path P on the guide bar 56 is at rest in the position shown in FIGS.

Figure 10:
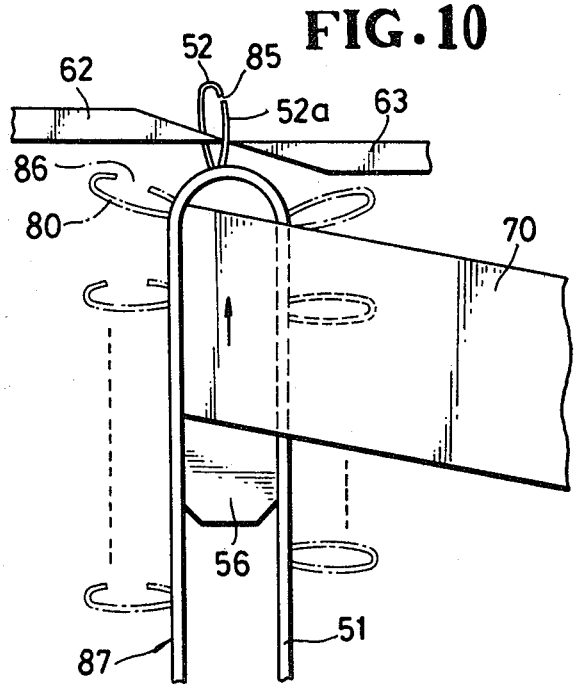

9(*a*) and 9(*b*). In this position one of the legs 52*a* of the respective loops 52 contact the die edges 83 of the stationary cutting member 62. At this time, the first projection 77 on the cam 75 starts engaging the follower roller 68 to move the rocker arms 64,65 pivotally in the counterclockwise direction as viewed in FIG. 7, whereupon the movable cutting member 63 begins to move toward the stationary cutting member 62. When the top or vertex of the first projection 77 engages with the follower roller 68, the cutting edges 81 and the die edges 83 are brought into contact with each other, whereby the loops 52 are cut on their respective legs 52*a* at a first point 85 located near the outer ends of the respective loops 52. The follower roller 68 then rolls down along the slope of the first projection 77 and the movable cutting member 63 moves toward its retracted position. The second projection 78 on the cam 75 then passes over both the follower rollers 68,73 whereupon the rocker arms 64,65 rotate in counterclockwise direction to move the movable cutting member 63 toward the stationary cutting member 62 while the support levers 70,71 rotate in the clockwise direction to slightly move the guide bar 56 upwardly in perpendicular relation to the reciprocating path of the cutting member 63 as viewed in FIG. 7. When the vertex of the second projection 78 engages the follower rollers 68,73, the cutting and die edges 81,83 come together to thereby cut the row of loops on their respective legs 52*a* at a point adjacent to the surface 53 on the base 51 and spaced remotely from the first cutting point 85 (FIG. 10).

The foregoing cycle of cutting operation is repeated each time a row of loops 52 is introduced in the reciprocating path of the cutting members 62,63. Each hook-shaped material engaging element 80 on a hooked fastener part 87 thus formed has a relatively large opening 86 which allow a loop or loops on a mating looped fastener part (not shown) to enter into hooking engagement with the hook-shaped element 80 when two fastener parts are brought into face-to-face contact together.

Although certain preferred embodiments of the invention have been described in detail, many modifications and variations of the invention are possible in the light of the above teachings. For example, the spaced recesses 34,36;82,84 in the cutting members 23,24;62,63 may be formed in either one of the cutting members. The stationary cutting member 23;62 may be formed to have a flattened surface against which the cutting edges 33;81 of the movable cutting member 24;63 impinge.

Although various minor modifications may be suggested by those versed in the art, it should be understood that we wish to embody within the scope of the patent warranted thereon, all such embodiments as reasonably and properly come within the scope of our contribution to the art.

What is claimed is:

1. A method of manufacturing a hooked fastener part for hook-and-loop fasteners, comprising the steps of:

(a) feeding a continuous base of sheet material, having a number of successive rows of laterally spaced loops projecting from one surface of the base, in a longitudinal direction along an arcuate path with said loops directed away from the center of said arcuate path;

(b) introducing said rows of loops, successively into a given reciprocating path of a cooperating pair of cutting members relatively movable toward and away from each other along said reciprocating path; and (c) cutting each loop of one of said rows on one of its legs at two different points by reciprocating said cutting members two times while said one row of loops is in said reciprocating path of said cutting members along said arcuate path.

2. A method according to calim 1 wherein said reciprocating path of said cutting members extends in a plane substantially parallel to a tangent to said arcuate path.

3. A method according to claim 2 wherein said tangent extends to touch said arcuate path at the middle point of said arcuate path.

4. A method of manufacturing a hooked fastener part for hook-and-loop fasteners, comprising the steps of:

(a) feeding a continuous base of sheet material, having a number of successive rows of laterally spaced loops projecting from one surface of the base, intermittently in a longitudinal direction along an arcuate path with said loops directed away from the center of said arcuate path;

(b) introducing said rows of loops, while being intermittently fed along said arcuate path, successively one at a time into a given reciprocating path of a cooperating pair of cutting members relatively movable toward and away from each other along said reciprocating path, said reciprocating path extending in a plane substantially parallel to a tangent to said arcuate path;

(c) cutting each loop of one of said rows on one of its legs at a first point between the outer end of each loop and said surface of the base by once reciprocating said cutting members while said one row of loops is at rest in said reciprocating path of said cutting members;

(d) displacing said center of said arcuate path in a direction perpendicular to said plane of said reciprocating path while said one row of loops is at rest in said reciprocating path of said cutting members; and (e) cutting each loop of said one row, while at rest in said reciprocating path, on its one leg at a second point spaced from said one point by again reciprocating said cutting members.

5. A method according to claim 4 wherein said tangent extends to touch said arcuate path at the middle point of said arcuate path.

6. An apparatus for manufacturing a hooked fastener part for hook-and-loop fasteners, comprising:

(a) means providing an arcuate path for guiding therealong a continuous base of sheet material having a number of successive rows of laterally spaced loops projecting from one surface of the base with said loops directed away from the center of said arcuate path;

(b) means for feeding said base in a longitudinal direction along said arcuate path on said guide means;

(c) a cooperating pair of cutting members disposed adjacent to said arcuate path on said guide means and relatively movable toward and away from each other along a given reciprocating path; and (d) means for actuating said cutting members in synchronism with said feeding means such that said cutting members reciprocate two times while one of said rows of loops are being fed in said reciprocating path of said cutting member along said arcuate path on said guide means.

7. An apparatus according to claim 6 wherein one of said cutting member is fixed to a frame of the apparatus and the other cutting member is secured to a rocker arm pivotably mounted on the frame, said actuating means comprises a cam rotatably mounted on the frame and a cam follower mounted on said rocker arm and normally urged against said cam, said cam having a cam surface disposed for engagement with said cam follower to thereby twice reciprocate said movable cutting member with respect to said stationary cutting member each time said cam complete one revolution.

8. An apparatus according to claim 6 wherein at least one of said cutting members has a series of discrete edges engageable with an edge of the other cutting member and a series of recesses formed between every two adjacent pair of said edges and defining jointly with said edge of the other cutting member a series of openings for receiving therein one leg of the respective loops of said one row of loops when said movable and stationary cutting members are brought into contact with each other.

9. An apparatus for manufacturing a hooked fastener part for hook-and-loop fasteners, comprising:

(a) means providing an arcuate path for guiding therealong a continuous base of sheet material having a number of successive rows of laterally spaced loops projecting from one surface of the base with said loops directed away from the center of said arcuate path;

(b) means for feeding said base intermittently in a direction along said arcuate path on said guide means;

(c) a cooperating pair of cutting members disposed adjacent to said arcuate path on said guide means and relatively movable toward and away from each other along a given reciprocating path, said reciprocating path extending in a plane substantially parallel to a tangent to said arcuate path;

(d) means for actuating said cutting members to reciprocate twice with respect to one another each time one of said rows of loops is at rest in said reciprocating path; and (e) means for displacing said center of said arcuate path on said guide means in a direction perpendicular to said reciprocating path of said cutting members in a predetermined timed relation to the reciprocating movement of said cutting members.

10. An apparatus according to claim 9 wherein one of said cutting members is fixed to a frame of the apparatus and the other cutting member is supported by a pair of rocker arms pivotably mounted on the frame, said actuating means comprising a cam rotatably mounted on the frame and a cam follower mounted on one of said rocker arms and normally urged against said cam, said cam having a cam surface disposed for engagement with said cam follower to thereby twice reciprocate said movable cutting member with respect to said stationary cutting member each time said cam complete one revolution.

11. An apparatus according to claim 9 wherein said guiding means comprises a guide bar movably mounted on a frame of the apparatus, and said displacing means comprises a cam rotatably mounted on the frame, a pair of support levers pivotably mounted on the frame and supporting said guide bar, and a follower roller mounted on one of said support levers and normally urged against said cam, said cam having a cam surface disposed for engagement with said cam followers to thereby displace said guide bar in a direction perpendicular to said reciprocating path of said cutting members in the predetermined timed relation to the movement of said cutting members.

12. An apparatus according to claim 9 wherein at least one of said cutting members has a series of discrete edges engageable with an edge of the other cutting member and a series of recesses formed between adjacent pairs of said edges and defining jointly with said edge of the other cutting member a series of openings for receiving therein one leg of the repsective loops of said one row of loops when said movable and stationary cutting members are brought into contact with each other.

13. A method according to claim 1, said continuous base being continually fed.

14. A method according to claim 1, said continuous base being intermittently fed.

15. An apparatus according to claim 6, at least one of said relatively movable cutting members having a series of discrete edges engageable with an edge of the other cutting member and a series of recesses formed between every two adjacent pair of said edges.

* * * * *